US008702023B2

(12) United States Patent
Enderle

(10) Patent No.: US 8,702,023 B2
(45) Date of Patent: Apr. 22, 2014

(54) STIRRING BALL MILL

(71) Applicant: Udo Enderle, Marktrewitz (DE)

(72) Inventor: Udo Enderle, Marktrewitz (DE)

(73) Assignee: Netzch-Feinmahltechnik GmbH (DE)

( * ) Notice: Subject to any disclaimer, the term of this patent is extended or adjusted under 35 U.S.C. 154(b) by 0 days.

(21) Appl. No.: 13/871,615

(22) Filed: Apr. 26, 2013

(65) Prior Publication Data

US 2013/0233953 A1 Sep. 12, 2013

Related U.S. Application Data

(63) Continuation of application No. PCT/DE2011/001864, filed on Oct. 18, 2011.

(30) Foreign Application Priority Data

Oct. 27, 2010 (DE) ..... 10 2010 049 827

(51) Int. Cl.
*B02C 17/16* (2006.01)

(52) U.S. Cl.
USPC ..... 241/171; 241/172

(58) Field of Classification Search
USPC ..... 241/171, 172
See application file for complete search history.

(56) References Cited

U.S. PATENT DOCUMENTS 5,335,867 A * 8/1994 Stehr et al. ..... 241/69

FOREIGN PATENT DOCUMENTS

| | | | |
|---|---|---|---|
| DE | 1184611 | B | 12/1964 |
| DE | 1288890 | B | 2/1969 |
| DE | 2414686 | A1 | 10/1975 |
| DE | 3642320 | A1 | 6/1988 |
| DE | 202008006745 | U1 | 7/2008 |
| EP | 1468739 | A1 | 10/2004 |
| EP | 2189221 | A2 | 5/2010 |
| WO | 9749780 | A1 | 12/1997 |

OTHER PUBLICATIONS

International Search Report Application No. PCT/DE2011/001864 Completed: Apr. 18, 2012; Mailing Date: May 8, 2012 2 pages.

* cited by examiner

*Primary Examiner* — Mark Rosenbaum
(74) *Attorney, Agent, or Firm* — St. Onge Steward Johnston & Reene LLC

(57) ABSTRACT

The agitator ball mill according to the invention for grinding dry or non-dry substances is provided with a grinding container. The grinding container is provided with an inlet for the material to be ground, a fluid inlet and a material outlet, wherein the outlet region is provided with a screen. Running in the center or in the vicinity of the center of the grinding container is an agitator shaft, on which a plurality of grinding elements are disposed. The grinding container is at least partially filled with auxiliary grinding bodies. A first cage is assigned to the inlet region of the agitator ball mill and a second cage to the outlet region.

19 Claims, 5 Drawing Sheets

STIRRING BALL MILL

FIELD OF THE INVENTION

The present invention relates to an agitator ball mill for the preferential grinding of dry or non-dry substances.

BACKGROUND OF THE INVENTION

The agitator ball mill according to the invention for grinding dry or non-dry substances is provided with a grinding container. The grinding container is provided with an inlet for the material to be ground, a fluid inlet and a material outlet, wherein the outlet region is provided with a screen. Running in the centre or in the vicinity of the centre of the grinding container is an agitator shaft, on which a plurality of grinding elements are disposed. The grinding container is at least partially filled with auxiliary grinding bodies. A first cage is assigned to the inlet region of the agitator ball mill and a second cage to the outlet region.

German patent specification DE 36 42 320 C2 discloses an agitator mill for grinding, in particular the dry grinding of pigments, with a cylindrical container, in which grinding bodies are located and which is provided with an inlet for the stock to be ground and an outlet for the ground stock. Disposed in the axis of the container is a driveable agitator, the effective surfaces whereof have a smaller spacing from the internal wall of the container than the diameter of the grinding bodies. At least two effective surfaces are present, which extend along surface lines of the container and fully cover the container in the axial extension.

German Auslegeschrift DE 1 288 890 discloses a method for the dry fine crushing of solids in an agitator mill operating at high speed. The vertically disposed grinding container of the agitator mill is partially filled with grinding bodies and a gas flows through the latter. The grinding stock flow and the gas flow constantly conveyed directly and almost exclusively through the grinding body/grinding stock mixture are controlled in such a way that the free space between the grinding bodies is filled 10 to 60% with grinding stock. The agitator comprises plane solid discs fitted concentrically on an agitator shaft.

German patent specification DE 1 184 611 B discloses a screening machine with at least one circular screen swivellable out of the horizontal and a device for cleaning the screen by means of air jets, said device being rotatable beneath the screen area. This air-jet screen cleaning arrangement comprises air supply pipes mounted slightly rotatable beneath the screen, which are connected to a central distributor chamber acted on by a blower with air, and air outlet openings. At least some of these air outlet openings are disposed in such a way that the air supply pipes with their supports can be put into a rotational movement parallel to the screen area by the blowback of emerging air.

German patent specification DE 24 14 686 describes a method for screening a screening-stock mixture supplied pneumatically from above to a screen area by pneumatically conveying the fine stock through the screen area. The screen is provided with a pneumatic screen cleaning arrangement acting in the counter-flow to the delivery direction, said screen cleaning arrangement being in the form of a compressed air blowing device periodically sweeping over the underside of the screen area. The frequency and intensity of the cleaning air jets blown from the opposite side through the screen are sufficient in relation to the impacting screening stock flow to prevent the formation of a deposit of more than a monograin thickness.

German utility model DE 20 2008 006 745 U1 relates to a grinding disc with an annular body and with a plurality of cams, wherein the cams are connected detachably to the annular body. The cams are made of a ceramic material, preferably of an yttrium-stabilised zirconium oxide ceramic. Furthermore, the cams are screwed to the annular body, the cams being screwed radially to the annular body.

SUMMARY OF THE INVENTION

The problem underlying the invention is to make available an agitator ball mill for the economical and operationally reliable grinding of dry or non-dry substances to form very fine grinding stock.

The above problem is solved by an agitator ball mill comprising the features of the independent claim. Further advantageous features can be derived from the dependent claims.

The agitator ball mill according to the invention for the grinding of dry or non-dry substances comprises a grinding container, which is filled at least partially with auxiliary grinding bodies. The grinding container is provided with an inlet and an outlet for the material to be ground or grinding stock and with a fluid inlet. The supplied air is used as a carrier medium for the transport of the material or the grinding stock in the agitator ball mill. It is clear to the person skilled in the art that, instead of air, other fluids can also be used that may be better suited for the grinding tasks. In the case of explosive substances, used may be made for example of inert gases. Furthermore, there is disposed in the outlet region of the agitator ball mill a screen, downstream of which a removal device is disposed. The removal of the grinding stock, which has passed through the screen, is ensured with this removal device. An agitator shaft, on which a plurality of grinding elements are disposed, runs centrally in the grinding container.

A first cage is assigned to the inlet region of the agitator ball mill and a second cage to the outlet region. Disposed in the centre of the screen is a cleaning device, with which grinding stock present on the external side of the screen can be removed from the screen. The grinding elements that are disposed in the inlet region and in the outlet region are constituted in such a way that they can transport the grinding stock and the auxiliary grinding bodies into the middle of the grinding container. As a result of this exact guidance of the material and auxiliary grinding bodies, very good efficiency can be achieved with the agitator ball mill according to the invention.

The cleaning device can be moved in a rotary manner in the centre of the screen. Furthermore, the cleaning device is provided with at least one device for expelling a cleaning medium. The supply to the cleaning device takes place via a channel which runs through the agitator shaft.

The employed cleaning medium can be a gas and/or a vaporised liquid. The selection of the cleaning medium is guided by the requirements of the material to be ground. When use is made of steam, only superheated dry steam is usually used in the case of dry grinding. If gas is used, air or an inert gas is preferably used. It has been shown that air, in particular, is very well suited, since no particular requirements are made on the user and the machine for the purposes of handling.

The addition and/or the frequency of addition of the cleaning medium to the cleaning device can be freely regulated. The screen is installed separately or integrated into a screen cartridge.

At least a first grinding element assigned to the inlet region is constituted in such a way that it transports the grinding stock and the auxiliary grinding bodies in the delivery direction of the agitator ball mill. At least a last grinding element assigned to the outlet region is, in contrast, constituted in such a way that it transports the grinding stock and the auxiliary grinding bodies against the delivery direction of the agitator ball mill.

The grinding elements assigned to the inlet region and/or the outlet region each comprise at least one additional element, with which the transport of the grinding stock and the auxiliary grinding bodies is ensured. The additional element of the grinding element in the inlet region is inclined in the delivery direction of the agitator ball mill. The additional element of the grinding element in the outlet region is inclined against the delivery direction of the agitator ball mill.

The additional elements are connected detachably to the grinding elements. As a result of this detachable connection, it is possible to adapt the inclination of the additional elements with respect to the grinding elements according to the requirements of the grinding process.

The first cage facing the inlet region comprises fewer cage bars than the second cage in the outlet region. The cage bars of the second cage can be moved with a greater peripheral speed than the cage bars of the first cage. The first cage is located in the region of the inlet and of the fluid inlet.

The diameter of the second cage is greater than the diameter of the first cage. As a result of the lower peripheral speed of the first cage, the material to be ground is introduced correspondingly uniformly into the air flow. As a result of the higher peripheral speed of the second cage, the auxiliary grinding bodies are kept almost completely away from the screen area. Apart from by means of the diameters of the first cage and the second cage having a different size, these advantages can only be achieved by means of cages driven separately. This would however mean a much higher outlay on equipment and control.

The previously described features are particularly well suited for solving the problem of the invention. They are in particular the differently constituted cages, the grinding elements provided with additional elements in the inlet region and in the outlet region, as well as the screen provided with a cleaning device in the outlet region. Due to the difficult processing of dry materials, reference is made in particular here to the need for the combination of the individual components and their interaction.

Examples of embodiment of the invention and its advantages will be explained below in greater detail with the aid of the appended figures. The size ratios of the individual elements with respect to one another in the figures do not always correspond to the actual size ratios, since some forms are represented simplified and other forms enlarged in relation to other elements for the sake of better clarity.

DETAILED DESCRIPTION OF THE INVENTION

Figure 1:
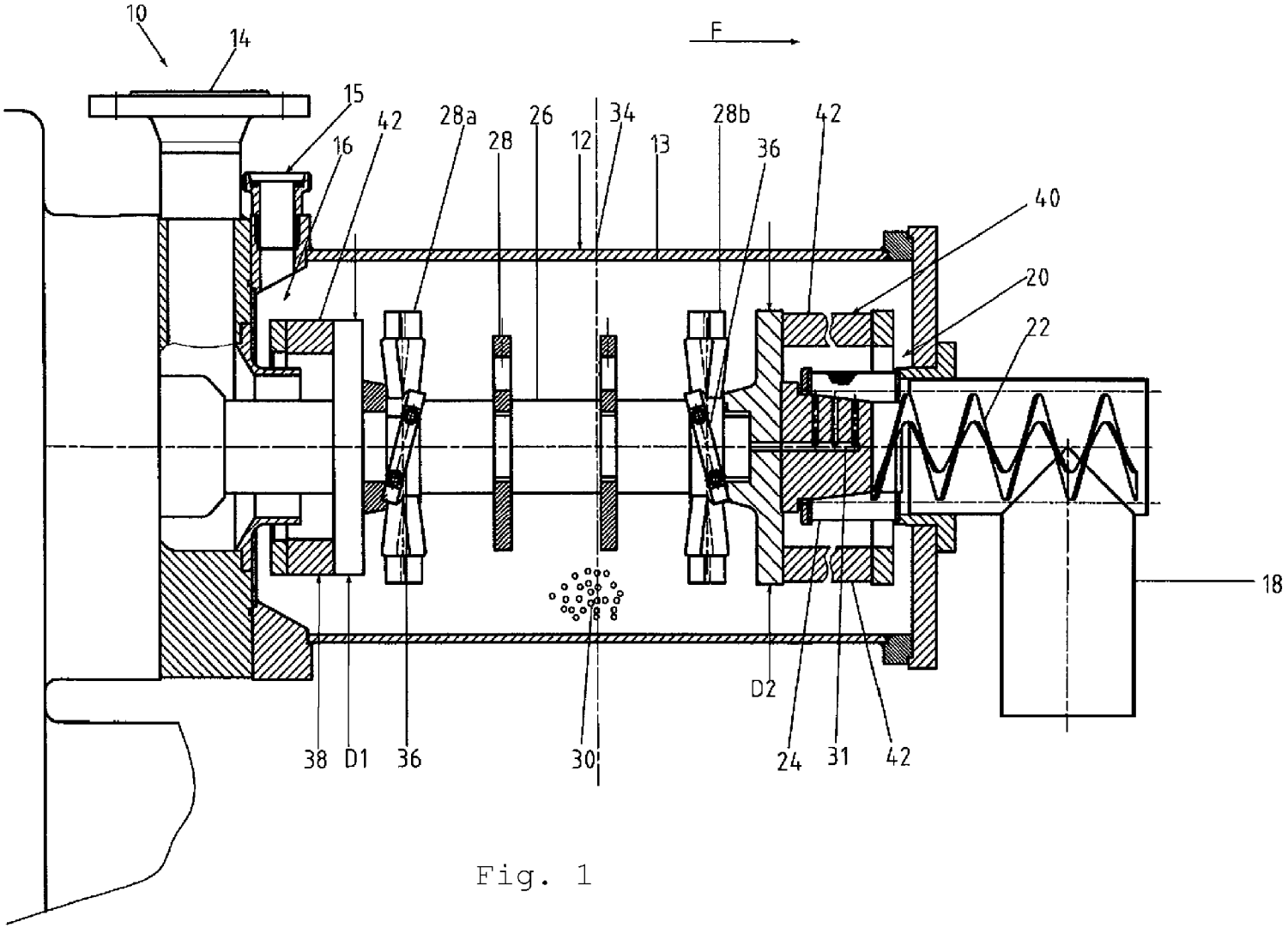
FIG. 1 shows the diagrammatic structure of an agitator ball mill according to the invention.

FIG. 1 shows the diagrammatic structure of an agitator ball mill 10 according to the invention. Agitator ball mill 10 comprises primarily a grinding container 12 and an agitator shaft 26 on which different grinding elements 28, 28*a* and 28*b* are disposed. Grinding container 12 comprises a grinding container wall 13, which is provided with an inlet 14 for the material to be ground, a fluid inlet 15 and an outlet 18. In order to move the grinding stock (not represented) through agitator ball mill 10, air is introduced as a carrier medium via fluid inlet 15 into agitator ball mill 10. So-called cages 38 and 40 are disposed on agitator shaft 26 in inlet region 16 and in outlet region 20. First cage 38 is assigned to inlet region 16 and second cage 40 to outlet region 20. The material to be ground and the carrier air are mixed by first cage 38 in inlet region 16 of agitator ball mill 10. Due to the fact that cages 38, 40 rotate with agitator shaft 26, auxiliary grinding bodies 30 and as yet unground grinding stock are moved away from agitator shaft 26 in the direction of grinding container wall 13. Cages 38 and 40 are formed by different cage bars 42. First cage 38 comprises fewer cage bars 42 than second cage 40. First grinding element 28*a* after inlet 14 and last grinding element 40 before outlet 18 are constituted differently from the other grinding elements 28. First grinding element 28*a* and second grinding element 28*b* are each provided with additional elements 36 in order to influence the flow of the grinding stock and auxiliary grinding bodies 30. These additional elements 36 are inclined in such a way that the grinding stock and auxiliary grinding bodies 30 are conveyed into middle 34 of agitator ball mill 10. For this purpose, the grinding stock and auxiliary grinding bodies 30 are conveyed out of inlet region 16 in delivery direction F and from outlet region 20 by means of grinding element 28*b* against delivery direction F.

A screen 24 is located inside second cage 40 in outlet region 20 of agitator ball mill 10. This screen 24 further serves to keep auxiliary grinding bodies 30 out of outlet 18. Disposed in the centre of screen 24 is a rotary cleaning device 31, with which screen 24 can be cleaned by a cleaning medium from the inside outwards.

In order that the dry grinding stock can be removed continuously from agitator ball mill 10, represented agitator ball mill 10 is provided with a screw-like removal device 22.

Figure 2:
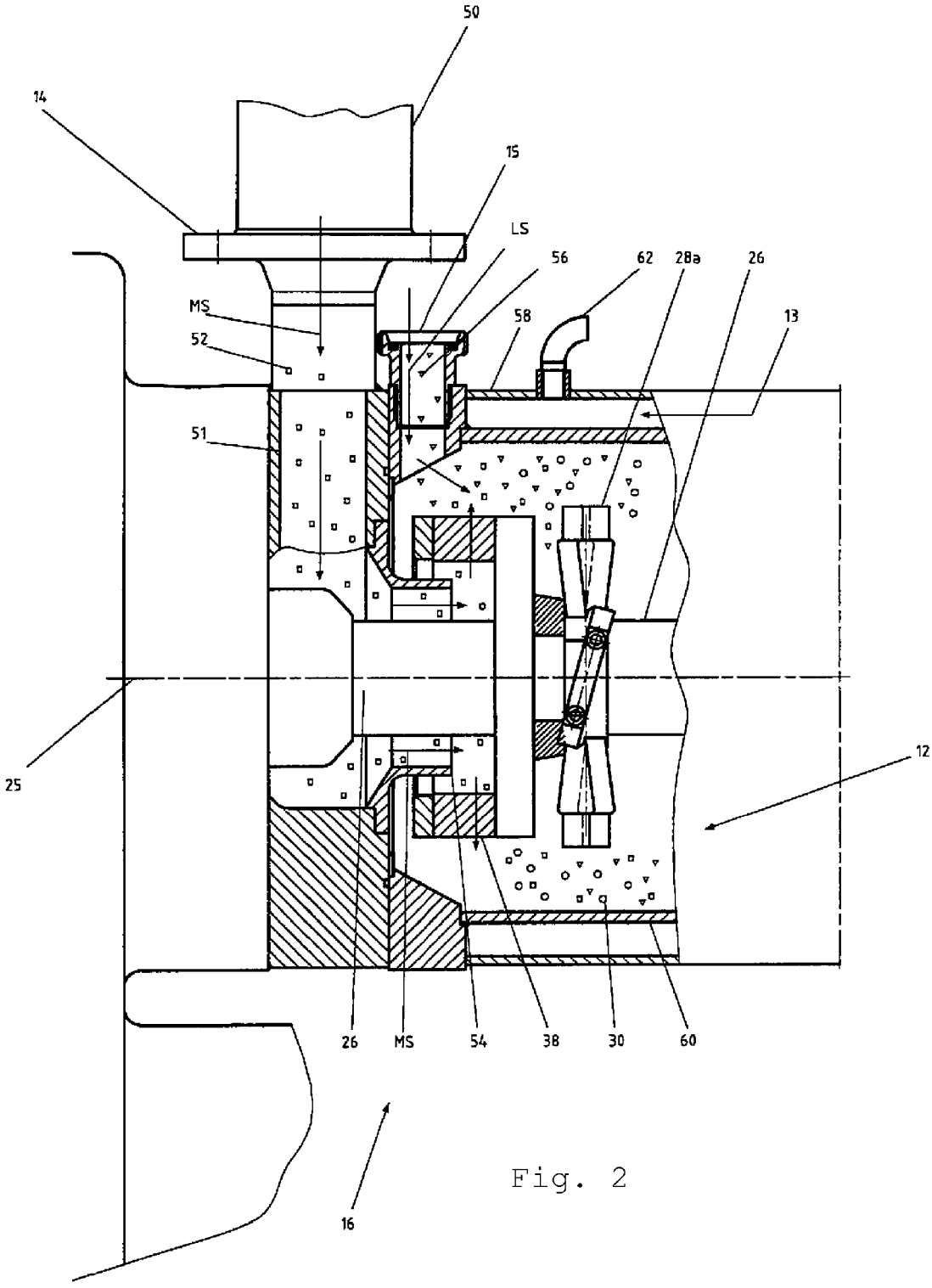
FIG. 2 shows diagrammatically the structure of the inlet region of the agitator ball mill.

FIG. 2 shows diagrammatically the structure of inlet region 16 of the agitator ball mill. Material 52 to be ground is fed in a metered manner by means of a cellular wheel sluice 50 to inlet 14 and from there to the agitator ball mill. Material 52 is conveyed via a line 51 into the vicinity of agitator shaft 26. In the region of agitator shaft 26, material 52 is conveyed through a material guide 54 into the centre of first cage 38. Material flow MS from first cage 38 into grinding container 12 is mixed there with air flow LS, which flows through fluid inlet 15 into grinding container 12. First grinding element 28*a*, which is moved by agitator shaft 26, conveys the mixture of material 52 and air 56 as well as material 52 and auxiliary grinding bodies 30 into a central zone (not represented) in the region of the agitator ball mill in which the highest auxiliary grinding body density occurs.

Apart from fluid inlet 15, a heating and/or cooling medium inlet 62 is represented. Through this inlet 62, it is possible to introduce a heating and/or cooling medium into grinding container wall 13 constituted double-walled and by doing so to adjust the optimum temperature for the grinding process in grinding container 12.

Figure 3:
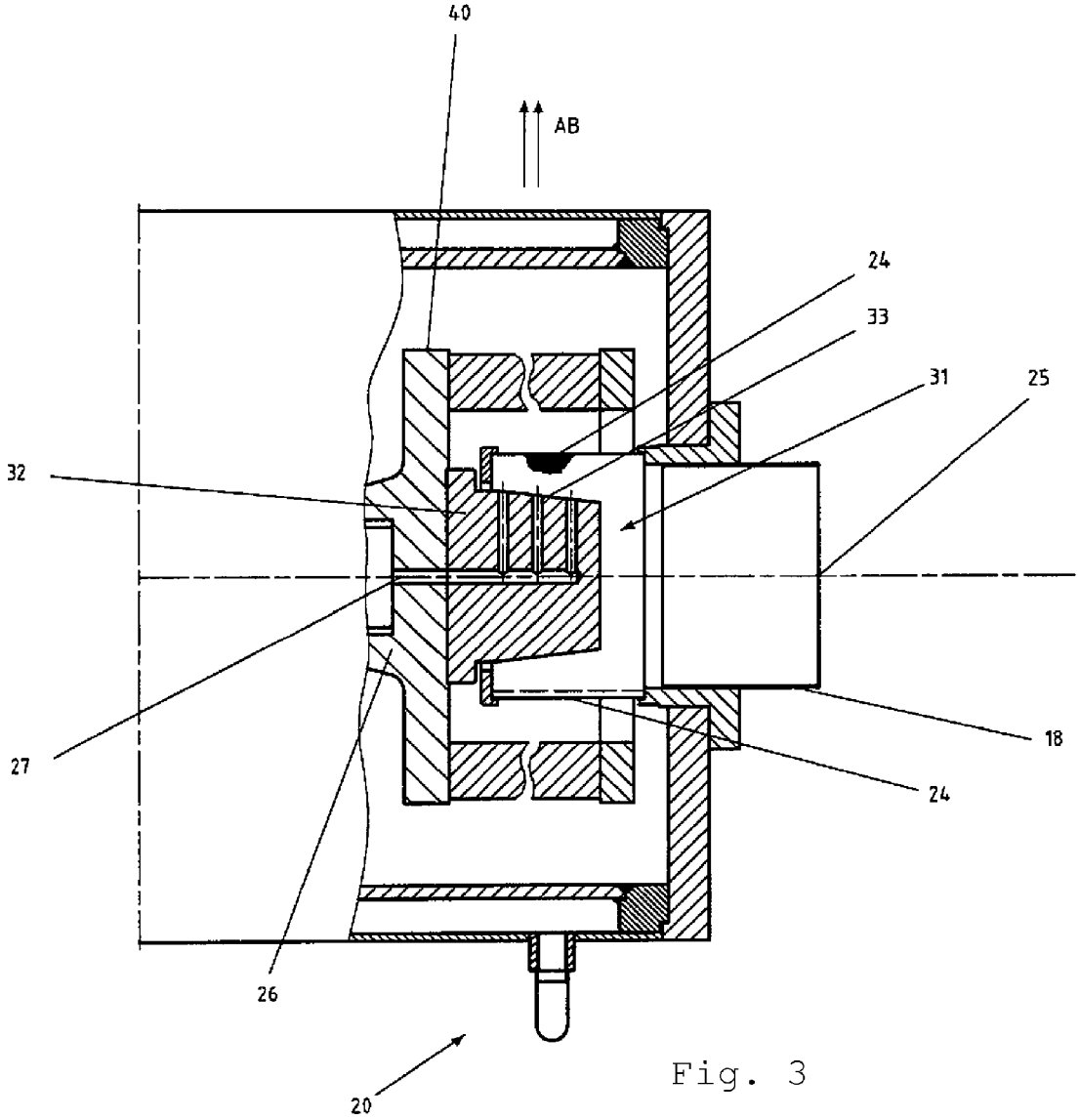
FIG. 3 shows diagrammatically the structure of the outlet region of the agitator ball mill.

FIG. 3 shows diagrammatically the structure of outlet region 20 with a cleaning device 31 for screen 24. Cleaning device 31 is located in the centre of screen 24 in the extension of agitator shaft 26. The base 32 of cleaning device 31 is constituted conical, so that its diameter diminishes from agitator shaft 26 of the direction of outlet 18. Cleaning device 31 can be rotated together with agitator shaft 26 about its rotational axis 25. Cleaning device 31 is supplied with cleaning medium through a channel 27 which runs through agitator shaft 26. The cleaning medium is blown by means of pressure through outlet channels 33 of rotating cleaning device 31 into the interior of screen 24. Grinding stock adhering in and on screen 24 is thus conveyed back into outlet region 20 or into the interior of second cage 40. In the represented example of embodiment, outlet channels 33 of cleaning device 31 point upwards and would blow the cleaning medium radially in direction AB through screen 24. On account of the concentration of outlet channels 33 onto a partial zone of screen 24, the rest remains free for the passage of the grinding stock. To this extent, the cleaning can also take place during the grinding process.

Figure 4:
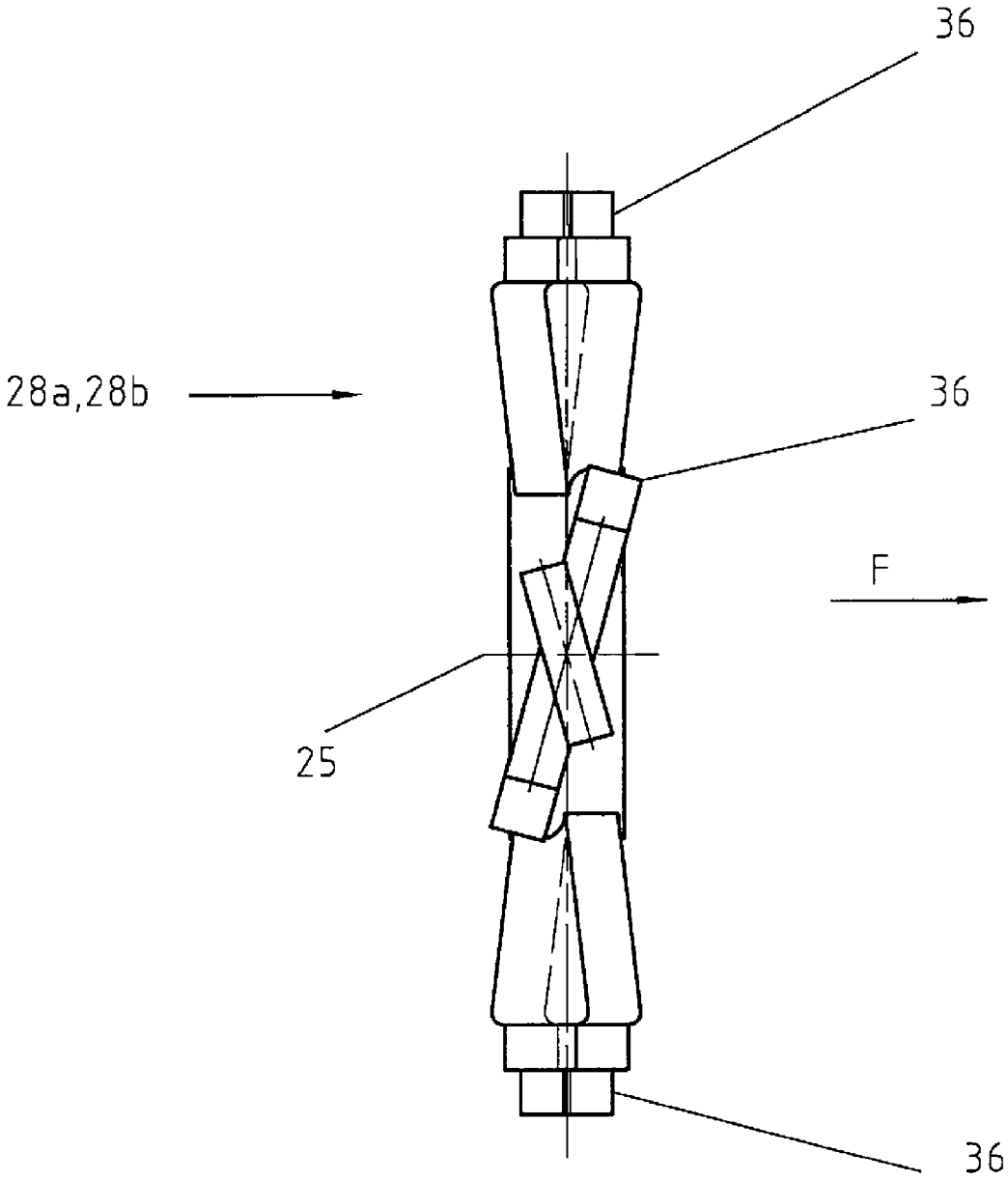
FIG. 4 shows diagrammatically the structure of an additional grinding element in a side view.

FIG. 4 shows diagrammatically the structure of a grinding element 28*a*, 28*b* in a side view. Each grinding element 28*a*, 28*b* is provided with a plurality of additional elements 36. As a result of the inclination of additional element 36, the grinding stock would be transported in this example of embodiment in delivery direction F. Grinding element 28*a*, 28*b* is rotationally symmetrical and can be rotated with the agitator shaft (not represented) about rotational axis 25 of the agitator shaft.

Figure 5:
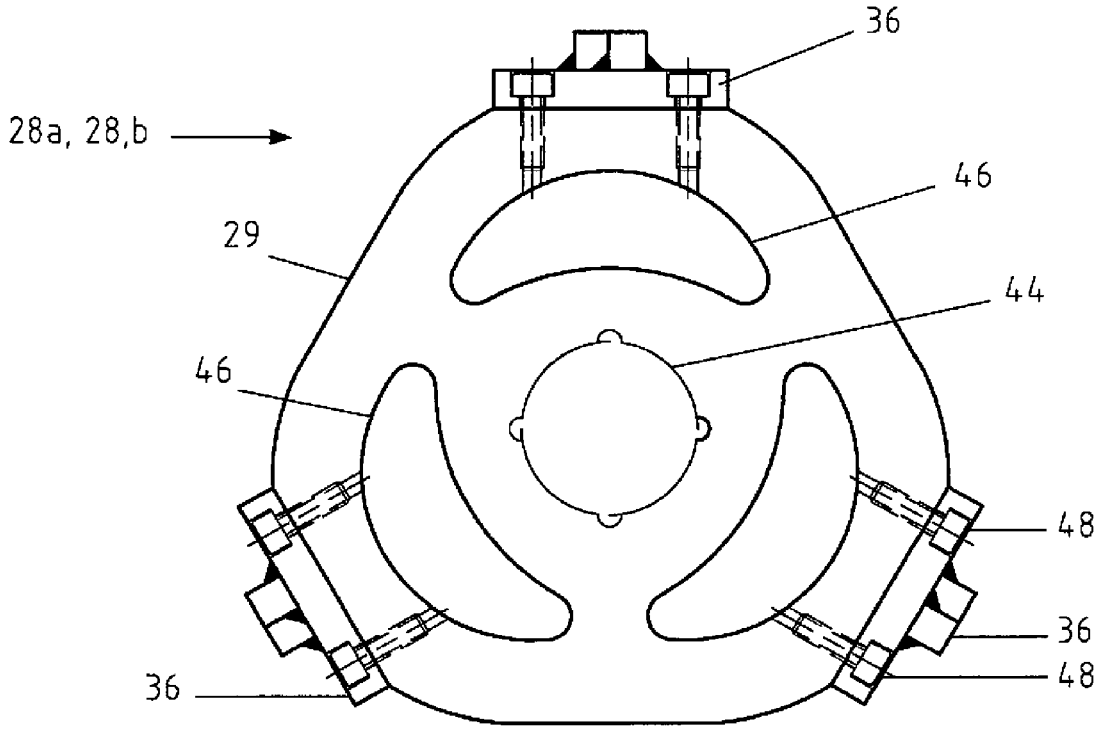
FIG. 5 shows diagrammatically the structure a preferred additional grinding element.

FIG. 5 shows diagrammatically the structure of a preferred grinding element 28*a*, 28*b*. Preferred grinding element 28*a*, 28*b* comprises a triangular base body 29. Shaft mounting 44 for the agitator shaft (not represented) is located in the centre of base body 29. Additional elements 36 are disposed at the rounded corners. Additional elements 36 are fixed by means of screws 48 to base body 29. Recesses 46 are introduced into base body 29 at three points. For reasons of rotational symmetry, these recesses are always located in the spatial vicinity of additional elements 36.

As a result of the fact that additional elements 36 are fixed with screws 48 to base body 29, said additional elements are interchangeable and/or can be fixed to the base body in an arbitrary position. The points at which additional elements 36 are disposed are, in this example of embodiment, the points of grinding element 28*a*, 28*b* which lie closest to the grinding container wall (not represented). As a result, the wear is greatest at these points. As a result of the fact that additional elements 36 are linked at these points and the possibility of replacement exists, additional elements 36 can also be made of a wear-resistant material.

What is claimed is:

1. An agitator ball mill for grinding dry or non-dry substances with a grinding container, which is filled at least partially with auxiliary grinding bodies;

an inlet and an outlet for a material to be ground or grinding stock;

a screen disposed in an outlet region;

an agitator shaft running through a centre of the grinding container; and a plurality of grinding elements disposed on the agitator shaft;

characterised in that a first cage is assigned to an inlet region and a second cage to the outlet region;

a fluid inlet is assigned to the inlet region; and a cleaning device is disposed in a centre of the screen, the cleaning device being movable in a rotary manner in the centre of the screen and being provided with at least one device for expelling cleaning medium.

2. The agitator ball mill according to claim 1, characterised in that the supply to the cleaning device is ensured via a channel which runs through the agitator shaft.

3. The agitator ball mill according to claim 1, characterised in that the employed cleaning medium is a fluid.

4. The agitator ball mill according to claim 3, characterised in that the employed fluid is air, inert gas or steam.

5. The agitator ball mill according to claim 1, characterised in that the addition and/or frequency of addition of the cleaning medium to the cleaning device can be regulated.

6. The agitator ball mill according to claim 1, characterised in that a removal device is disposed downstream of the screen.

7. The agitator ball mill according to claim 1, characterised in that the grinding elements in the inlet region and in the outlet region are constituted in such a way that they transport the grinding stock and the auxiliary grinding bodies into the middle of the grinding container.

8. The agitator ball mill according to claim 7, characterised in that the at least one first grinding element assigned to the inlet region is constituted in such a way that it transports the grinding stock and the auxiliary grinding bodies in the delivery direction of the agitator ball mill.

9. The agitator ball mill according to claim 7, characterised in that the at least one last grinding element assigned to the outlet region is constituted in such a way that it transports the grinding stock and the auxiliary grinding bodies against the delivery direction of the agitator ball mill.

10. The agitator ball mill according to claim 7, characterised in that the grinding elements that are assigned to the inlet region and/or the outlet region each comprise at least one additional element, wherein the additional element of the grinding element in the inlet region is inclined in the delivery direction of the agitator ball mill and wherein the additional element of the grinding element in the outlet region is inclined against the delivery direction of the agitator ball mill.

11. The agitator ball mill according to claim 7 characterised in that the additional elements are connected detachably to the grinding elements.

12. The agitator ball mill according to claim 1, characterised in that the first cage assigned to the inlet region comprises fewer cage bars than the second cage in the outlet region.

13. The agitator ball mill according claim 12, characterised in that the cage bars of the second cage move with a greater peripheral speed than the cage bars of the first cage.

14. The agitator ball mill according to claim 12, characterised in that the first cage is located in the region of the inlet and/or of the fluid inlet.

15. The agitator ball mill according to claim 14, characterised in that the diameter of the second cage is greater than the diameter of the first cage.

16. The agitator ball mill according to claim 13, characterised in that the first cage is located in the region of the inlet and/or of the fluid inlet.

17. The agitator ball mill according to claim 8 characterised in that additional elements are connected detachably to the grinding elements.

18. The agitator ball mill according to claim 9 characterised in that the additional elements are connected detachably to the grinding elements.

19. The agitator ball mill according to claim 10 characterised in that the additional elements are connected detachably to the grinding elements.

* * * * *